US005469407A

United States Patent [19]

Saunders

[11] Patent Number: 5,469,407

[45] Date of Patent: Nov. 21, 1995

[54] PARACHUTE ARRAY

[75] Inventor: Roger I. Saunders, Hollis, N.H.

[73] Assignee: Lockheed Sanders, Inc., Nashua, N.H.

[21] Appl. No.: 268,533

[22] Filed: Jun. 1, 1981

[51] Int. Cl.[6] ..... H04R 1/44

[52] U.S. Cl. ..... 367/173

[58] Field of Search ..... 367/4, 130, 131, 367/173

[56] References Cited

U.S. PATENT DOCUMENTS

| | | | |
|---|---|---|---|
| 3,926,137 | 12/1975 | Johnson | 367/130 X |
| 3,944,964 | 3/1976 | Loeser et al. | 367/4 |
| 3,990,123 | 11/1976 | Stachiw et al. | 367/173 X |
| 4,004,265 | 1/1977 | Woodruff et al. | 367/130 X |
| 4,187,490 | 2/1980 | Ballard et al. | 367/130 X |
| 4,189,703 | 2/1980 | Bennett | 367/130 X |
| 4,298,964 | 11/1981 | Warnshuis, Jr. et al. | 367/4 |

FOREIGN PATENT DOCUMENTS

| | | | |
|---|---|---|---|
| 2020021 | 11/1979 | United Kingdom | 367/173 |

*Primary Examiner*—Daniel T. Pihulic
*Attorney, Agent, or Firm*—David W. Gomes

[57] ABSTRACT

This invention is a parachute array in which a plurality of hydrophones are attached to the skin of a planar or volumetric parachute or affixed to strings that are positioned around a planar or volumetric parachute. When the parachute is moved through water, the parachute will expand and provide the necessary tension forces to maintain and position the hydrophone array in a particular geometric orientation without the use of any rigid structural members.

34 Claims, 6 Drawing Sheets

PARACHUTE ARRAY

FIELD OF THE INVENTION

This invention relates generally to underwater listening devices and more particularly to the deployment of large aperture planar or volumetric hydrophone arrays.

BACKGROUND OF THE INVENTION

Sonar utilizes sound waves which are transmitted through the water. The sonar equipment receives sound signals from the water; amplifies the signals; and analyzes the signals so that the sonar operator will receive information about objects and their movements in the sea. Sonar systems receive sound energy from hydrophones. Hydrophones are used to convert sound energy into electrical signals. The electrical signals are then processed and displayed to a sonar operator who is typically aboard a ship or aircraft. The ability of a sonar operator to find or locate a target is dependent upon how faint a sound the hydrophone can detect and the ability of the sonar equipment to determine the location of the object that produced the detected sound.

One method utilized by the prior art to increase the range of hydrophones was to deploy an array of omni-directional hydrophones in a substantially horizontal straight line array beneath the ocean's surface (the sound detection power of the hydrophones increases by the $\sqrt{N}$, where N equals the number of hydrophones). One of the disadvantages of deploying omnidirectional hydrophones in a substantially straight line is that it does not permit the operator to determine which lobe (left or right) of the symmetric beam contains the target.

Another method utilized in the prior art for increasing the range and direction sensitivity of an array of hydrophones involved a mechanical structure containing rigid radial arms upon which are supported or suspended a symmetrical planar array of hydrophones. A disadvantage of positioning hydrophones with a rigid mechanical structure is that when such mechanical structures move through water, the joints of the mechanical structure flex when water passes them. The foregoing flexing produces background noises which interfere with the operation of the hydrophones. Another disadvantage of such mechanical structures is that usually the hydrophones could only be affixed to the radial arms of the structure and it was not practical to build a mechanical structure with more than about six radial arms. Thus, the hydrophones on different radial arms were positioned at least 60° apart which is acoustically disadvantageous as it limits the number of hydrophones which may be effectively employed. Furthermore, the radial arms were large, heavy and bulky, as they had to be both rigid when extended and yet capable of being collapsed so that the mechanical structure and hydrophones could be stored in a package of manageable size before the hydrophones were deployed. Mechanically structured arrays were also difficult to deploy, and costly since they were complex and difficult to fabricate.

SUMMARY OF THE INVENTION

This invention overcomes the disadvantages of the prior art by creating an inexpensive, small, light weight, quiet system that is easy to package and deploy and is capable of positioning any desired number of hydrophones in geometric, planar or volumetric array configurations. The apparatus of this invention positions or orients the hydrophones by having cord, wire or fabric, etc. connect the hydrophones to a slowly descending parachute. The reason why the foregoing is possible is that the hydrophones will be made neutrally buoyant so that when the parachute is moving through the water the parachute will cause the cord, wire or fabric to be taut and ensure that the hydrophones have a predetermined geometric orientation. Thus, the cord or wire is not actually holding the hydrophones, it is ensuring that the hydrophones remain in their prescribed position.

A large number of hydrophones may be connected to the parachute since the addition of another length of cord creates another radial arm. By increasing the length of the cord, the radial arms will be longer and the diameter of the hydrophone array will be greater, thereby increasing the gain or acoustic sensitivity of the array. Even though the above array can have a much larger diameter than the mechanical structure arrays utilized in the prior art, the apparatus of this invention can still be placed in a smaller package than those utilized by the prior art mechanical structure arrays since a folded parachute requires less space than a collapsable mechanical structure. It is also simpler and quicker to deploy a hydrophone array that utilizes a parachute rather than a mechanical structure.

Various types of slow moving parachutes, i.e., ring chutes, canopy chutes, segmented chutes with canopy segments, or Rogallo wings, hydro-inflated spherical chutes, hydro-inflated air foil chutes, etc., may be used to form numerous hydrophone array configurations. The hydrophones may be positioned in a circle that is parallel or perpendicular to the surface of the ocean. The hydrophones may also be positioned to form other types of plane geometric figures e.g. , triangles, quadrilaterals, etc. The hydrophones may also be positioned on the surface and/or the interior of solid figures like a sphere. All of the foregoing parachute configurations will supply sufficient tension to the material supporting the hydrophones to keep the hydrophones in a particular geometric orientation without the use of any rigid structural components. This system will also not produce flow noises since the parachute is designed to have a low velocity through water and the radial arms that connect the hydrophones to the parachute do not have any joints that flex under water.

It is an object of this invention to supply a system that utilizes a parachute to deploy a plurality of hydrophones and ensure that the hydrophones maintain a particular geometric orientation.

Other objects and advantages of this invention will become more apparent as the following description proceeds, which description should be considered together with the accompanying drawings.

DESCRIPTION OF A PREFERRED EMBODIMENT

The array system of this invention may be placed in the water in various ways, for example, by dropping it over the side of a surface vessel or launching it with a rocket, but it is believed that it will have its widest application when deployed by an aircraft. Accordingly, a preferred embodiment will first be described as so packaged and deployed.

Figure 1:
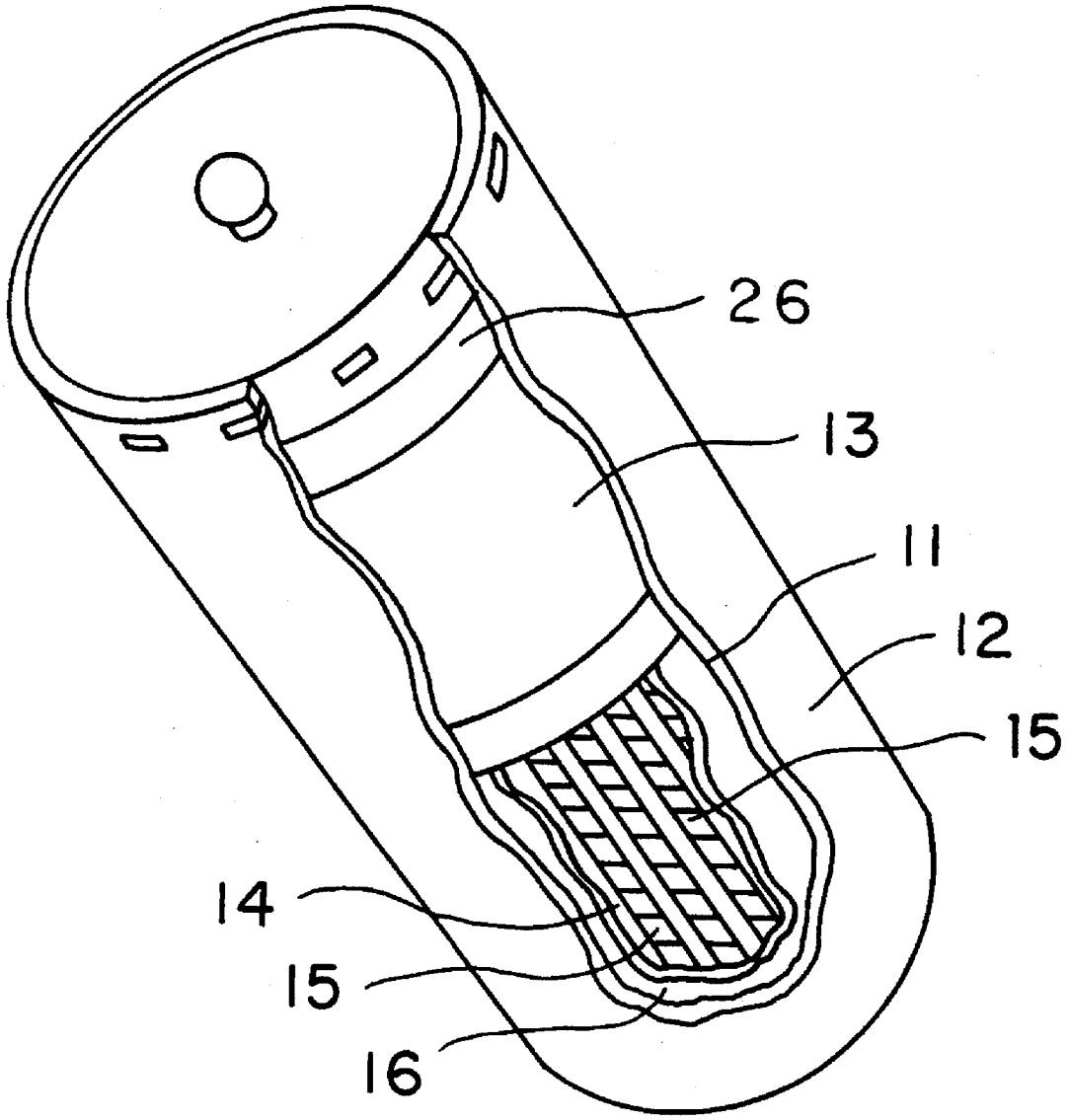
FIG. 1 is a perspective diagram showing how the components of the apparatus of this invention can be arranged within a sonobuoy.

Referring now to the drawings in detail and more particularly to FIG. 1, the reference character 11 designates the casing of the parachute array assembly 12 which has been cut away so as to show how some of the various components of this invention may be arranged therein prior to deployment of the array. Parachute 13, with a plurality of hydrophones and a transmitter float 26 (not shown) are stored in the top end of casing 11. Stored below parachute 13 is electronics housing 16 that contains a plurality of electronic circuit boards 15. Package 16 with its electronic contents will act as a sink weight to propel the parachute array downward.

Figure 2:
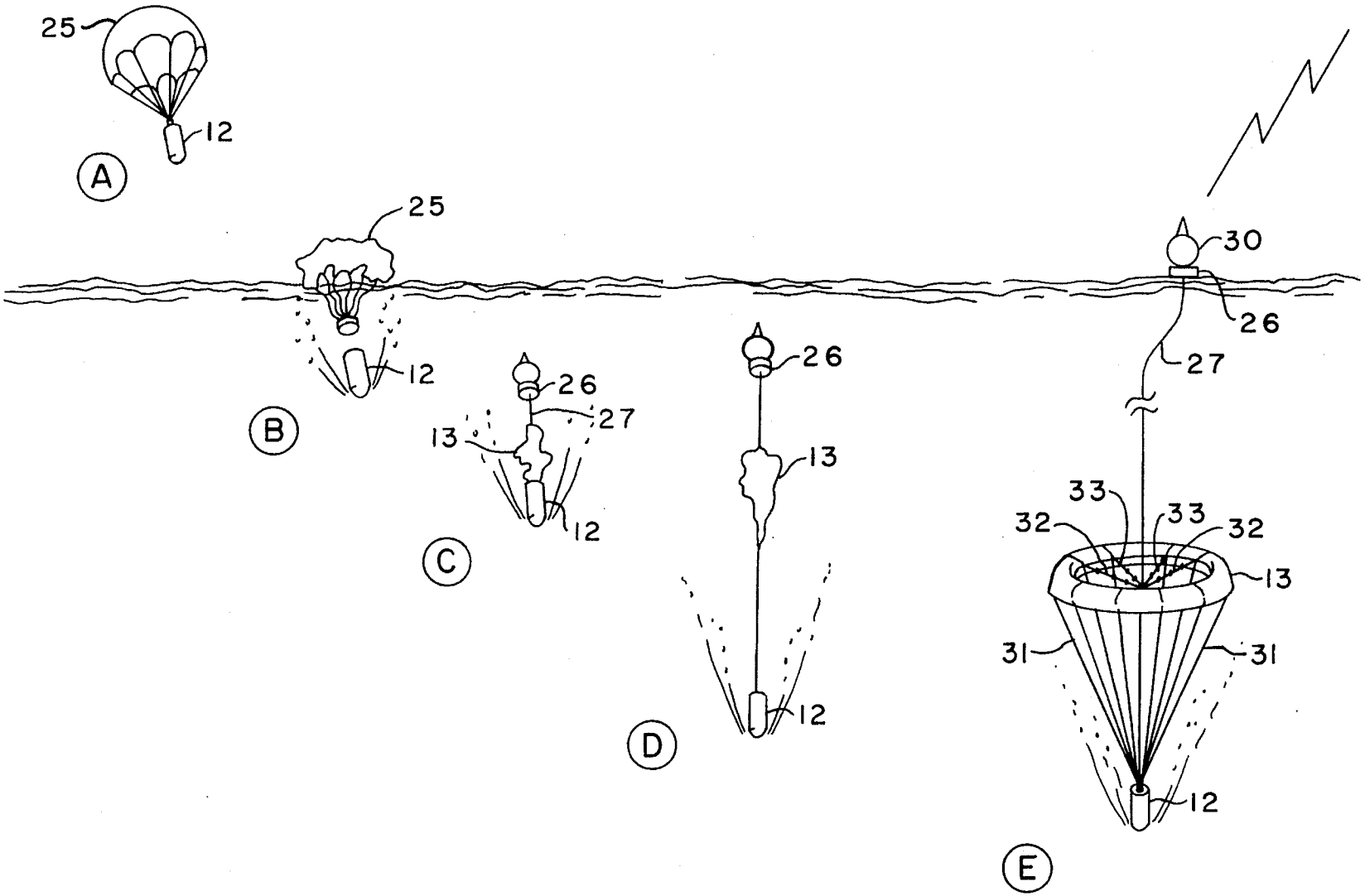
FIG. 2 is perspective view showing successive stages in the deployment of an air launched version of the array system of this invention.

FIG. 2 shows the elements contained within assembly 12 of FIG. 1 in various stages of deployment after having been launched from an aircraft. Stage A is just before the array assembly 12 hits the water, and stages B through F show its deployment just after it hits the water until it is fully deployed.

In stage A an air descent parachute 25 (which is not stored in casing 11) is utilized to slow the descent of assembly 12 so that it does not strike the water too hard.

In stage B parachute 25 is jettisoned and the remainder of assembly 12 starts its descent through the water.

Stage C will begin after the release of air descent parachute 25. At this time, transmitter float 26 (with antenna 30 inside) will be inflated and begin to rise to the surface. Cable 27, containing load bearing and signal carrying components, connects electronics housing 16 to transmitter float 26. Parachute 13 will be pulled from casing 11 to initiate its deployment.

During stage D float 26 will still be traveling towards the surface and parachute 13 will be completely removed from sonobuoy 12. The further descent of array assembly 12 will cause parachute 13 to open.

At stage E transmitter float 26 (with an RF transmitter and/or receiver inside that is not shown) has risen to the surface. Parachute 13 will be completely open (a ring parachute is shown but many other types of parachutes may be utilized which will become evident as this description proceeds). Guy wires 31 connect parachute 13 to assembly 12 and continue on to become radials 32 which are cords or wires that connect hydrophones 33 to electronics housing 16 which is also connected to cable 27. Hydrophones 33 are neutrally buoyant so they will not cause radials 32 to bow out of the horizontal plane. Radials 32 are tensioned by descending parachute 13 and this tension ensures that radials 32, with hydrophones 33 attached thereto, will remain in a horizontal plane. Therefore, nothing more than the radial line 32 are needed to position the hydrophones and ensure that the hydrophones have the proper orientation. Once parachute 13 is open, the rate of descent of assembly 12 will greatly decrease.

Hydrophones 33 are now properly positioned to receive signals. The signals that are received by hydrophones 33 are transmitted to package 16 via guy wires 31. Package 16 contains electronic equipment that processes the received hydrophone signals and may include beam forming and spectrum analysis, although in some instances it may be desirable to perform this aboard the receiving ship or aircraft. The processed signals are then transmitted via cable 27 to the transmitter (not shown) contained within transmitter float 26. Antenna 30 then sends the processed signal to a nearby aircraft. The aircraft crew then analyzes the received signals and determines whether or not an enemy vehicle has been detected.

The parachute array system has a finite operating life since parachute 13 and package 16 are continually descending to the floor of the ocean. Thus, package 12 can supply information to a nearby ship or aircraft until it hits the bottom of the ocean or until cable 27 is fully extended.

Figure 3:
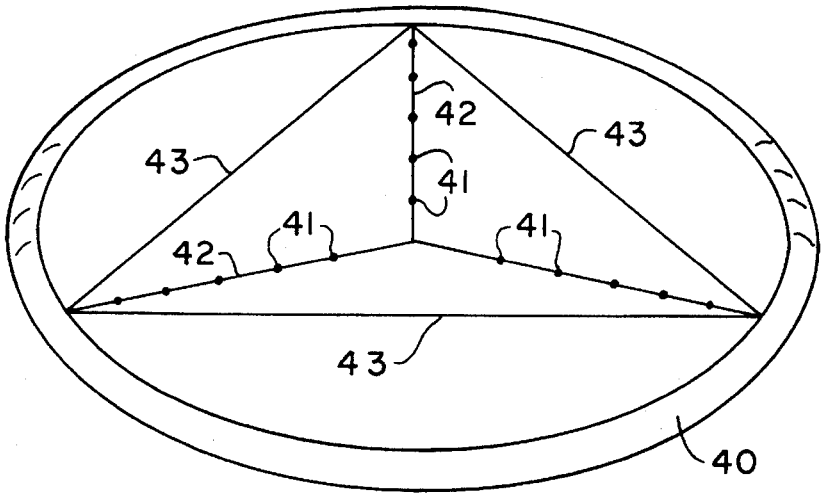
FIGS. 3–10 are perspective diagrams of modified forms of this invention.

Referring now to FIG. 3, therein is shown a modified arrangement of a plurality of hydrophones on a ring chute 40 which is similar to the parachute shown in FIG. 2. Hydrophones 41 are positioned on guy wires 42 so that the hydrophones will form a "Y" shaped array. Guy lines 43 are used to ensure that parachute 40 is properly deployed in the required configuration. In the event that one wants hydrophones 41 arranged to form a triangular array, then hydrophones 41 may be attached to guy wires 43 and guy wires 42 may be removed since they are no longer needed for support.

Figure 4:
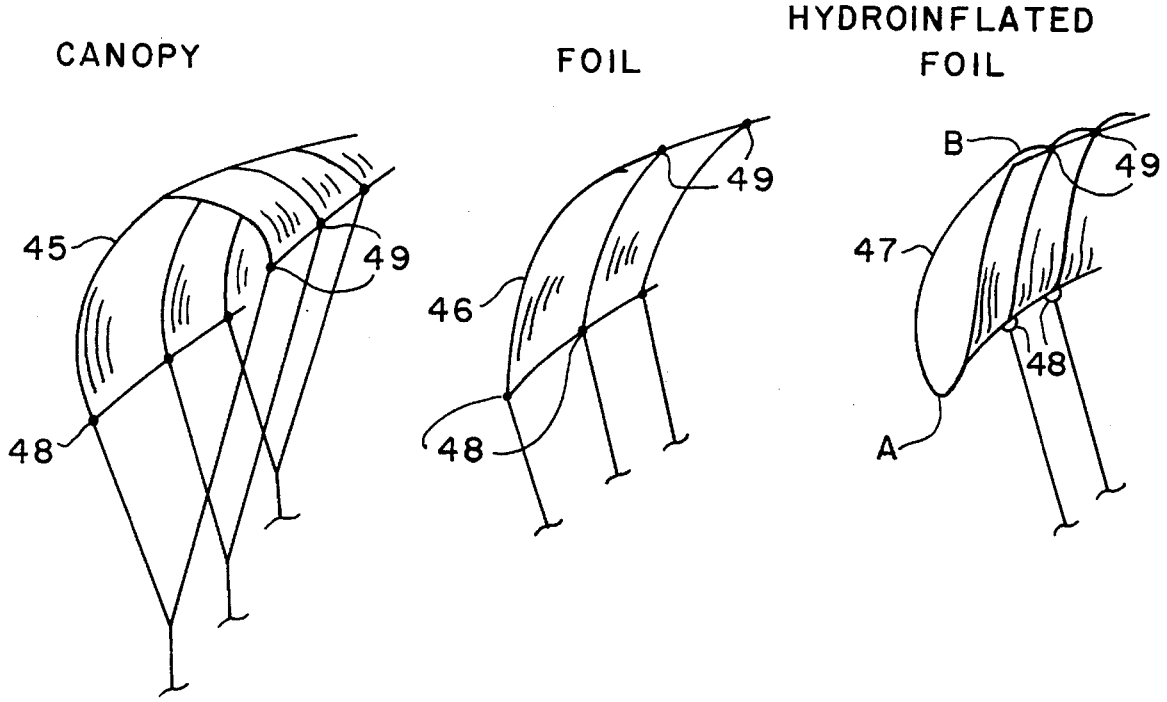

FIG. 4 shows some of the various canopy sections that may be used to form ring chute 13 of FIG. 2; namely, canopy chute 45, foil chute 46 and hydro-inflated foil 47. The strings or wires that are used to couple the hydrophones (not shown) to the parachutes may be attached at points 48, 49 or in between the two points. A hydro-inflated parachute is a three-dimensional or volumetric type of parachute that has a mouth opening along its bottom edge A and smaller vents along its upper edge B. As the parachute descends thru the ocean, water will enter the mouth of the hydro-inflated parachute causing the parachute to form a three-dimensional air foil configuration. The added lift of this air foil section increases the tension on the wires that are used to support the hydrophones and hence, causes the hydrophones to maintain a more fixed orientation. Hydro-inflated parachutes come in many different sizes and shapes and have been manufactured by Irvin Industries, 1501 South Sigueroa Street, Gardinia, Calif. 90248 and others.

Figure 5:
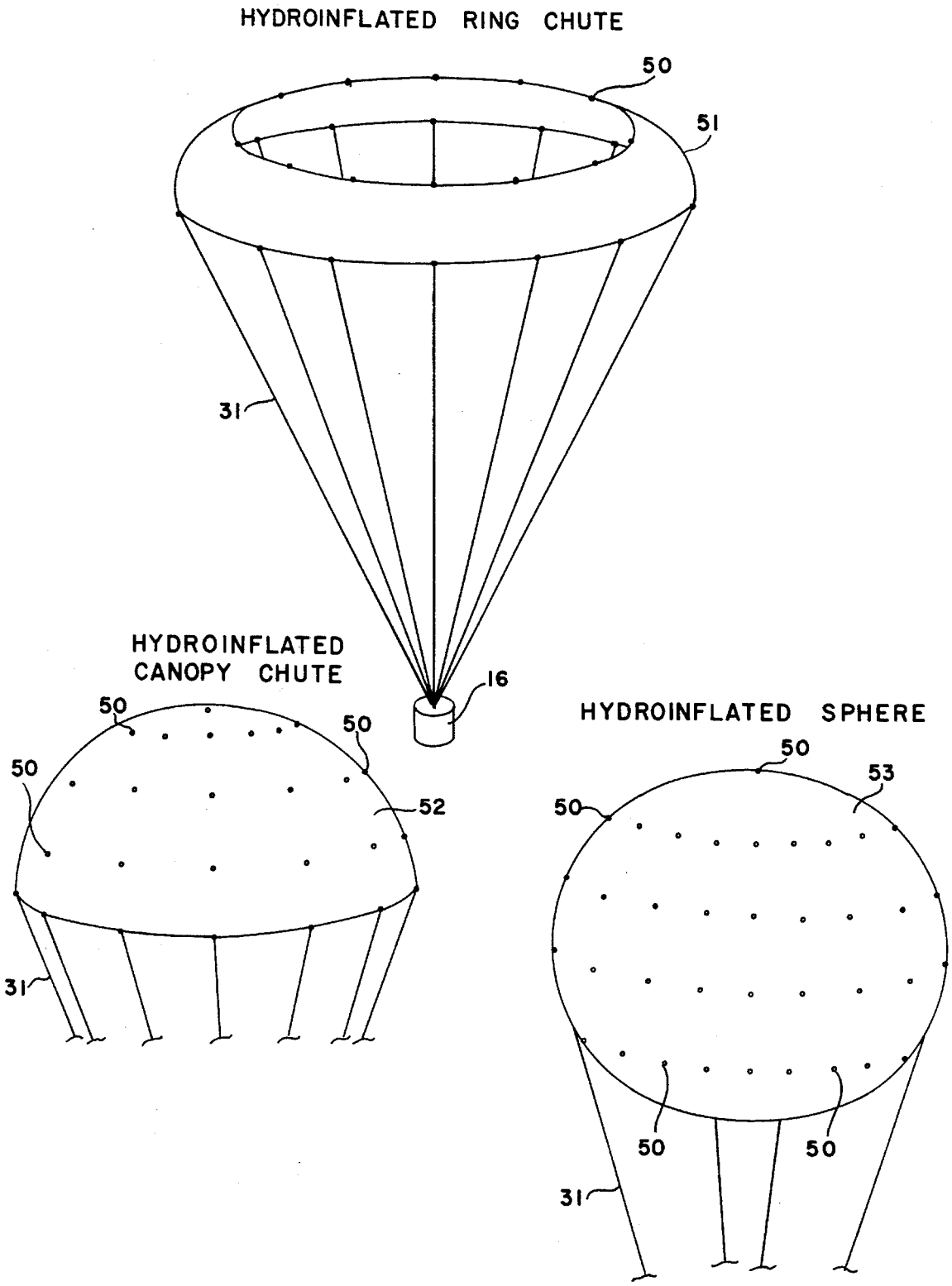

FIG. 5 illustrates the manner in which a plurality of hydrophones 50 may be positioned on a hydro-inflated ring chute 51 or a hydro-inflated canopy chute 52 or a hydro-inflated sphere 53. As depicted in the drawing, the hydrophones may be directly affixed to the skin of the parachute by extending the guy wires 31 to provide communication with electronics package 16. Hydrophones may also be connected to radial cables as shown in FIG. 2.

Figure 6:
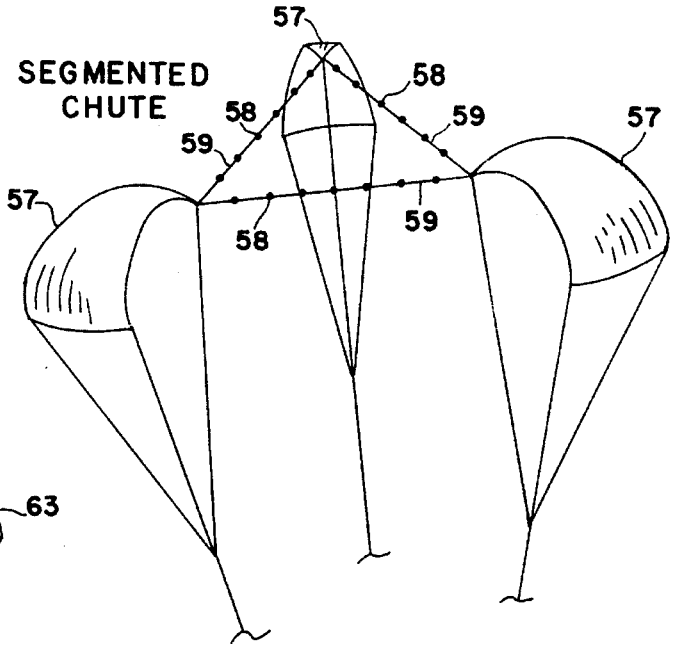

FIG. 6 illustrates an embodiment similar to that of FIG. 3 except that a segmented chute comprised of canopy segments 57 is utilized to position a plurality of hydrophones 58 which are attached to wires 59 in which are arranged in a triangular orientation. Rogallo wings or other types of hydrodynamic lifting sections may also be used to form a segmented chute.

The aforementioned parachutes described in FIGS. 1–6 are similar to parachutes used in air. The same technology that applies to parachutes that are used in the less dense medium, air, applies to parachutes that are used in the more dense medium, water. Thus, various types of parachutes are utilized for different types of hydrophone arrays and to control the rate of descent of the hydrophones. Increasing the projected area of a parachute will decrease its rate of descent. Hence, a ring chute falls faster than a canopy chute of the same diameter because it has less projected area.

Figure 7:
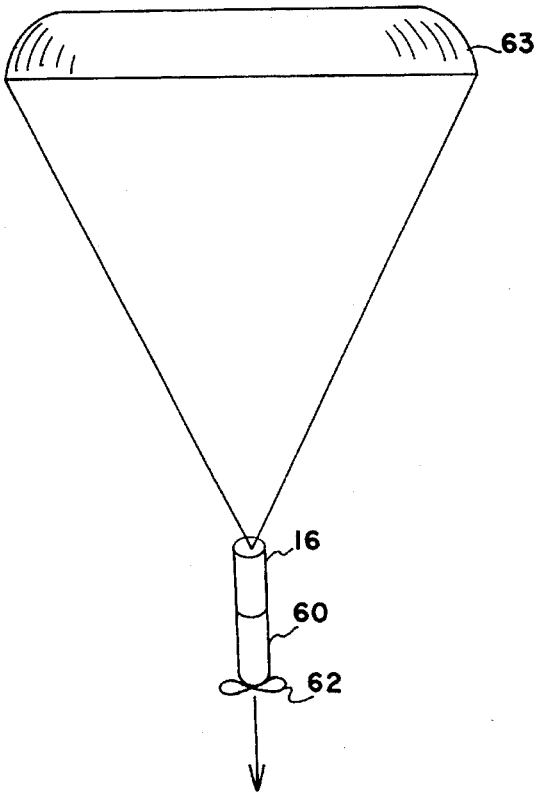

If the electronics package 16 does not have sufficient weight in water to cause the parachute array to sink at the desired velocity, such velocity could be achieved by the embodiment shown in FIG. 7. A powered thruster 60 is connected to package 16. Thruster 60 may use various types of internal or external power sources, such as electricity or compressed gas in conjunction with any of various propulsion arrangements, such as propellors, gas or water jets to run the thruster quietly. The operation of the thruster's propulsion system would create a force that would speed the descent of parachute 63. The only disadvantage to this particular method is that thruster 60 could increase the amount of background noise detected by the hydrophones (not shown). The hydrophones are connected and arranged with the parachute in the manner hereinbefore described.

Figure 8:
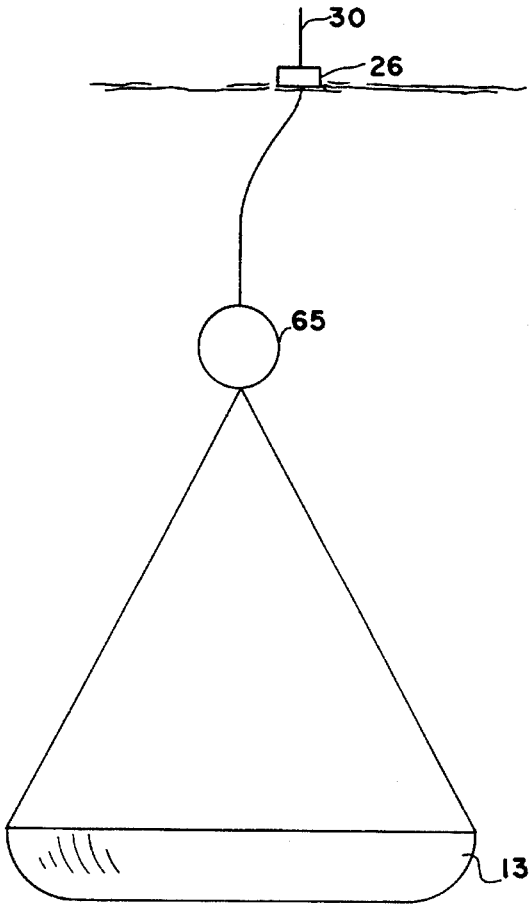

FIG. 8 illustrates an embodiment similar to that of FIG. 2 except that a float 65 which contains the electronics package replaces package 16 and parachute 13 is connected below the electronics package instead of above it. The deployment of the components of this embodiment is accomplished in a manner similar to that described in the description of FIG. 2. Float 26 and antenna 30 will be deployed at the same time as they were in FIG. 2; however, parachute 13 and float 65 will be carried down through the water in a fully stowed condition by a sink weight (not shown). At a certain preassigned depth or when they hit the ocean bottom, the sink weight is released along with parachute 13 and float 65. Once parachute 13 and float 65 are released, float 65 will begin to rise to the surface causing parachute 13 to open completely. A plurality of hydrophones (not shown) are connected to parachute 13 in the same manner heretofore described.

Figure 9:
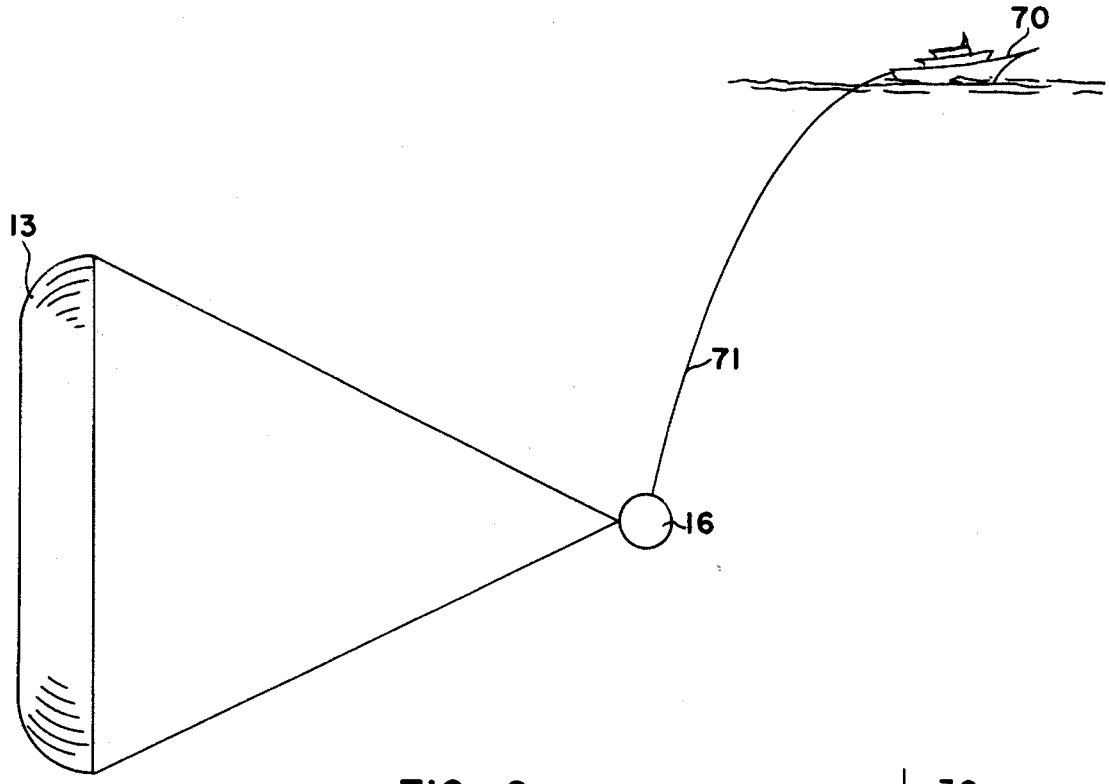

FIG. 9 illustrates an embodiment similar to that of FIG. 2 except that the array system is deployed from a ship 70 instead of an airplane and suspended such that parachute 13 with hydrophones attached thereto (not shown) is perpendicular to the ocean's surface and the signals of the hydrophones are transmitted directly to ship 70 by means of cable 71. The movement of ship 70 through the water ensures that parachute 13 remains open.

Figure 10:
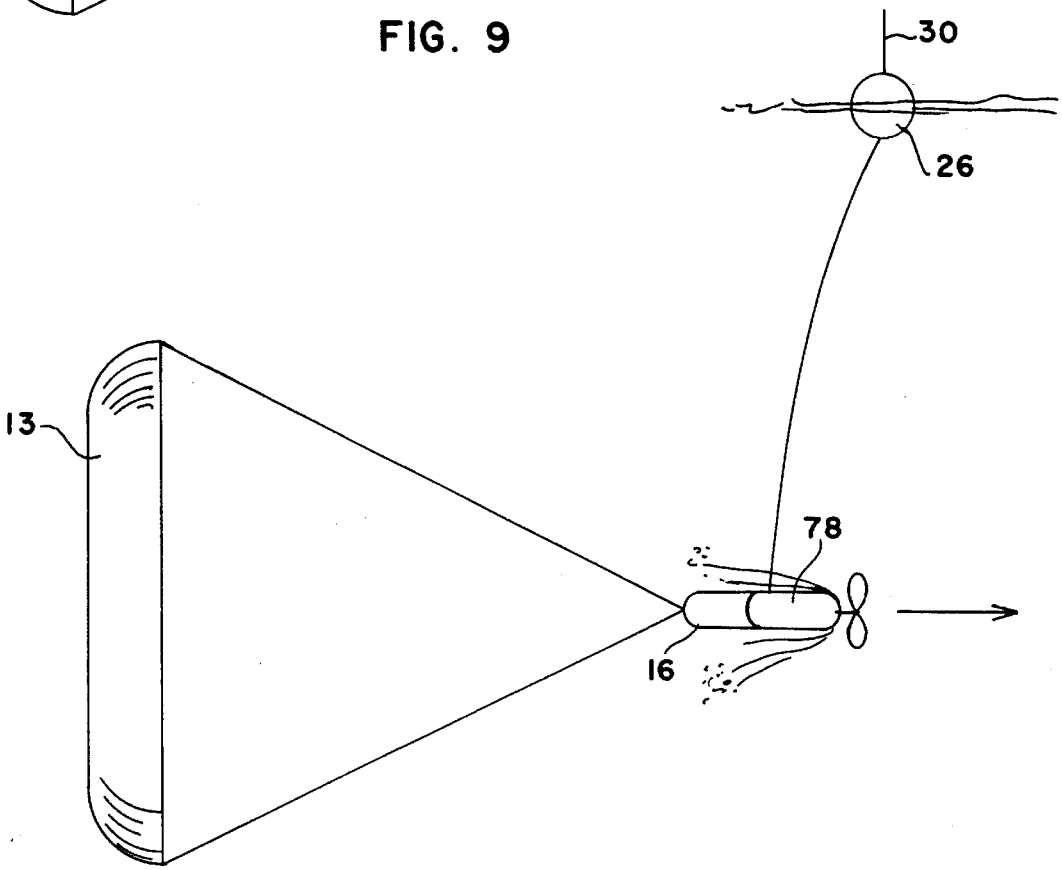

FIG. 10 illustrates an embodiment similar to that of FIG. 9 except that a thruster 78 is used to propel parachute 13 with a plurality of hydrophones attached thereto (not shown) instead of a ship, and the hydrophone signals are processed by the electronics contained in package 16 before being sent to float 26 and antenna 30. Thruster 78 will move parachute 13, package 16, float 26 and antenna 30 through the water and cause parachute 13 to remain in an open position.

The foregoing may also be accomplished by differential shear currents between the faster moving currents at the surface acting on float 30 and the slower moving current at depth acting on the parachute 13, in which case thruster 78 may be used only for deployment of the chute 13 or eliminated altogether.

The above specification has described a new and improved planar or volumetric array system that utilizes parachutes to position a plurality of hydrophones. Although several specific embodiments of this invention have been described in considerable detail for illustrative purposes, many modifications will occur to those skilled in the art. It is, therefore, intended that this invention be limited only by the scope of the appended claims.

What is claimed is:

1. A system for positioning and maintaining a hydrophone array in a predetermined configuration, comprising:

a parachute including at least one canopy section and a plurality of guy wires; and a plurality of hydrophones;

said hydrophones being coupled to said canopy section with at least one of said hydrophones being coupled to said canopy at one location and others coupled at different locations such that when said canopy section is inflated said canopy section will determine the configuration of the array.

2. The system claimed in claim 1 further including means for moving said parachute through the water, said moving means being coupled to said parachute.

3. The system claimed in claim 2 wherein said moving means is a sink weight.

4. The system claimed in claim 2 wherein said moving means is a thruster.

5. The system claimed in claim 2 wherein said moving means is a surface vessel that is connected to said parachute by a cable.

6. A method for positioning and maintaining a hydrophone array in a specified configuration including the steps of:

a) coupling a plurality of hydrophones to different locations on the canopy of a parachute, with at least one of the hydrophones coupled to the canopy at one location and others coupled at different locations; and b) moving said parachute through the water so that said parachute's movement will cause a force to be placed on said parachute to maintain said hydrophones in a predetermined orientation.

7. The system claimed in claim 1 further including means for transmitting the noise detected by said hydrophones to a central location where the noise may be processed.

8. The system claimed in claim 1 wherein said parachute is a ring chute.

9. The system claimed in claim 8 wherein said ring chute has hydro-inflated foil sections.

10. The system claimed in claim 8 wherein said ring chute has canopy sections.

11. The system claimed in claim 8 wherein said ring chute has foil sections.

12. The system claimed in claim 1 wherein said parachute is a hydro-inflated canopy chute.

13. The system claimed in claim 1 wherein said parachute is a hydro-inflated chute.

14. The system claimed in claim 9 wherein said hydro-inflated chute has a generally spherical shape.

15. The system claimed in claim 1 wherein said parachute is a segmented chute.

16. The system claimed in claim 11 wherein said segmented chute comprises a plurality of canopy elements.

17. The system claimed in claim 11 wherein said segmented chute comprises a plurality of rogallo wing elements.

18. The system claimed in claim 1 further including an array cable that is capable of transmitting electrical signals.

19. The system claimed in claim 1 wherein said moving means is a float.

20. The system claimed in claim 1 wherein the hydrophone array configuration is volumetric.

21. The system claimed in claim 1 further including means for coupling said hydrophones to said parachute.

22. The system claimed in claim 21 wherein said coupling means comprises:

a) a plurality of flexible members that are connected to said parachute, each one of said members having different geometric orientations; and b) means for attaching said hydrophones to said members.

23. The system claimed in claim 22 wherein said members are electrical cable.

24. The system claimed in claim 1 further including means for processing the signals received from said hydrophones.

25. The system claimed in claim 1 wherein said members are cord.

26. The system claimed in claim 24 wherein said processing means is a signal processor that processes the signals received from said hydrophones and transmits said signals to electronic equipment that is aboard a remote station.

27. The system claimed in claim 26 further including a float that floats on the water's surface and an antenna extending from said float so that said antenna may transmit the signals received from said signal processor to said electronic equipment.

28. The system claimed in claim 24 wherein said processing means is a signal processor that is located in a remote station.

29. The system claimed in claim 28 wherein said processing means further includes a float that floats on the water's surface and an antenna extending from said float so that said antenna may transmit the noise received from said hydrophone to said signal processor.

30. The system claimed in claim 1 further including a housing containing said parachute, moving means, said hydrophones, processing means and means for selectively deploying said parachute.

31. The system claimed in claim 1 further including a plurality of connecting members for connecting certain ones of said plurality of hydrophones to said canopy section.

32. The system claimed in claim 1 wherein said plurality of hydrophones are directly connected to said canopy section.

33. The system claimed in claim 1 wherein the hydrophone array configuration is non-linear.

34. The system claimed in claim 1 wherein the hydrophone array configuration is planar.

* * * * *